US008460427B2

(12) United States Patent
Tsai et al.

(10) Patent No.: US 8,460,427 B2
(45) Date of Patent: Jun. 11, 2013

(54) METHOD FOR MANUFACTURING METAL NANO PARTICLES HAVING HOLLOW STRUCTURE

(75) Inventors: Li-Duan Tsai, Hsinchu (TW); Kan-Lin Hsueh, Hsinchu County (TW); Sung-Chun Chang, Taipei (TW); Man-Yin Lo, Hsinchu (TW); Yu-Min Peng, Hsinchu (TW); Chun-Chieh Huang, Chiayi (TW); Ru-Shi Liu, Hsinchu County (TW); Hao-Ming Chen, Taipei County (TW); Hsin-Chieh Peng, Taoyuan County (TW)

(73) Assignee: Industrial Technology Research Institute, Hsinchu (TW)

( * ) Notice: Subject to any disclaimer, the term of this patent is extended or adjusted under 35 U.S.C. 154(b) by 1129 days.

(21) Appl. No.: 11/873,982

(22) Filed: Oct. 17, 2007

(65) Prior Publication Data

US 2009/0035575 A1 Feb. 5, 2009

(30) Foreign Application Priority Data

Dec. 14, 2006 (TW) ..... 95146850 A

(51) Int. Cl.
*B22F 9/16* (2006.01)
*B22F 9/18* (2006.01)
*B22F 9/24* (2006.01)

(52) U.S. Cl.
USPC ..... 75/371; 75/343; 75/370; 977/773; 977/775; 977/777; 977/810

(58) Field of Classification Search
USPC ..... 75/343, 351, 362, 370–374, 392, 75/710, 711, 721–726, 732, 733, 736, 738–741, 75/743, 744, 952, 953; 977/773–777, 810
IPC ..... B22F 9/16,9/18, 9/24
See application file for complete search history.

(56) References Cited

U.S. PATENT DOCUMENTS

2005/0056118 A1* 3/2005 Xia et al. ..... 75/330
2006/0202382 A1* 9/2006 Lin ..... 264/182

FOREIGN PATENT DOCUMENTS

CN 1616165 A 5/2005
CN 1895822 A 1/2007

OTHER PUBLICATIONS

Pr. Selvakannan and Murali Sastry, "Hollow gold and platinum nanoparticles by a transmetallation reaction in an organic solution," Chemical Communications, 2005, pp. 1684-1686.*

(Continued)

*Primary Examiner* — Scott Kastler
*Assistant Examiner* — Vanessa Luk
(74) *Attorney, Agent, or Firm* — J.C. Patents

(57) ABSTRACT

A method for manufacturing metal nano particles having a hollow structure is provided. First, a suitable reducing agent is added into a first metal salt solution, and first metal ions are reduced to form first metal nano particles. Next, after the reducing agent is decomposed, a second metal salt solution with a higher reduction potential than that of the first metal is added. Then, the first metal particles are oxidized to form first metal ions when the second metal ions are reduced on the surface of the first metal by electrochemical oxidation reduction reaction, and thus, second metal nano particles having a hollow structure and a larger surface area are obtained. The method is simple and the metal nano particles with uniform particle size are obtained by this method.

1 Claim, 3 Drawing Sheets

OTHER PUBLICATIONS

Vesna V. Vukovic and Jovan M. Nedeljkovic, "Surface Modification of Nanometer-Scale Silver Particles by Imidazole," Langmuir, 9 (1993), pp. 980-983.*

Pierre-Yves Silvert, Ronaldo Herrera-Urbina, Nicholas Duvauchelle, Venugopal Vijayakrishnan, Kamar Tekaia Elhsissen, "Preparation of colloidal silver dispersions by the polyol process, Part I-Synthesis and Characterization," Journal of Materials Chemistry, 6(4) (1996), pp. 573-577.*

Howard Glicksmann, "Production of Precious Metal Powders: Silver, Gold, Palladium, and Platinum," "Platinum Powders," vol. 7: Powder Metal Technologies and Applications, ASM Handbooks Online, ASM International, 2002.*

Hawley's Condensed Chemical Dictionary, 14th Edition, John Wiley & Sons, 2002, Definition: "room temperature."*

Murali Sastry, K.S. Mayya, V. Patil, D.V. Paranjape, S.G. Hegde, "Langmuir-Blodgett Films of Carboxylic Acid Derivatized Silver Colloidal Particles: Role of Subphase pH on Degree of Cluster Incorporation," Journal of Physical Chemistry B, 101 (1997), pp. 4954-4958.*

Ashvani Kumar, Hrushikesh Joshi, Renu Pasricha, A.B. Mandale, Murali Sastry, "Phase transfer of silver nanoparticles from aqueous to organic solutions using fatty amine molecules," Journal of Colloid and Interface Science, 264 (2003), pp. 396-401.*

Yugang Sun, Brian T. Mayers, Younan Xia, "Template-Engaged Replacement Reaction: A One-Step Approach to the Large-Scale Synthesis of Metal Nanostructures with Hollow Interiors," Nano Letters, vol. 2, No. 5, 2002, pp. 481-485.*

Yugang Sun, Brian Mayers, and Younan Xia, "Metal Nanostructures with Hollow Interiors," Advanced Materials, 15(7-8) (2003), pp. 641-646.*

Jun Li, Ying Liang, Qing-Chi Xu, Xian-Zhu Fu, Jeff Qiang Xu, Jing-Dong Lin, Dai-Wei Liao, "Synthesis and Characterization of Sub-10 nm Platinum Hollow Spheres as Electrocatalyst of Direct Methanol Fuel Cell," Journal of Nanoscience and Nanotechnology, vol. 6 (2006), pp. 1107-1113.*

J. Yang, Jim Yang Lee, Heng-Phon Too, S. Valiyaveettil, "A Bis(p-sulfonatophenyl)phenylphosphine-Based Synthesis of Hollow Pt Nanospheres," Journal of Physical Chemistry B, 110 (2006), pp. 125-129.*

Jingyi Chen et al., "Gold Nanocages: Engineering Their Structure for Biomedical Applications" Advanced Materials, 2005, vol. 17, pp. 2255-2261.

* cited by examiner

METHOD FOR MANUFACTURING METAL NANO PARTICLES HAVING HOLLOW STRUCTURE

CROSS-REFERENCE TO RELATED APPLICATION

This application claims the priority benefit of Taiwan application serial no. 95146850, filed on Dec. 14, 2006. All disclosure of the Taiwan application is incorporated herein by reference.

BACKGROUND OF THE INVENTION

1. Field of the Invention

The present invention relates to a method for manufacturing metal nano particles. More particularly, the present invention relates to a method for manufacturing metal nano particles having a hollow structure and metal nano particles manufactured by the method.

2. Description of Related Art

Fuel cell is a power generating device obtaining the electric power by means of electrochemically reacting hydrogen gas with oxygen gas in the presence of a catalyst to generate water. The fuel cell is a product of a new power generating technology with high efficiency, low pollution, and diversified energy, and the hydrogen of the fuel cell enables the system to generate power, which not only has the advantages of cleanness and high efficiency, as compared with the conventional fossil fuel, but also it can further be combined with power generating technologies such as nuclear energy, biomass energy, solar energy, and wind energy, such that the usage of the energy is diversified, renewable, and continuous.

The fuel cell has a simple composition, and a modularized structure, which thus has a wide application scope, and the specific application field includes: space energy, life support system, submarine power, bus, car, locomotive, bicycle, distributed power generation, household independent power generation, commercial and industrial backup power generating system, PDA, notebook computer, cell phone, portable power supply for electrical products, and power unit for military/defense purpose.

In the fuel cell, an anode catalyst plays a crucial role in catalyzing the decomposition of the hydrogen gas to generate protons. After researching for several decades, the result shows that the platinum catalyst achieves the most preferred efficiency. In order to enlarge the active area of the reaction, and to reduce the using amount of the platinum, platinum is usually made into particles smaller than 5 nm. Since the size of the particles is reduced to the nanometer level, the platinum loses its original metal luster and presents a color of black, so it is called platinum black. As for the current technology, the electrolytic reaction of the hydrogen molecules can be effectively catalyzed when the using amount of the platinum in the catalyst is about 0.5 $mg/cm^2$. Although the process for preparing the platinum black is simple, when the platinum black is used as the catalyst, the platinum black particles easily get close to each other and get aggregated, such that the active surface area is reduced, and the utilization efficiency of the catalyst is lowered.

In order to solve the above problems, recently two methods are proposed. The first method is using a protecting agent, dispersing agent, or a surface modifier to improve the dispersibility of the platinum blacks, but the improving efficiency is limited, and furthermore, the adopted protecting agent or the dispersing agent generates negative affects on the overall electron/proton conduction. The second method is using nanocarbon as the carrier (i.e. carbon-supported platinum catalyst) to effectively disperse the catalyst and to enhance the utilization efficiency. In addition, the carbon has a desirable electrical conductivity, and slightly affects the whole impedance. However, the size of the carbon capsules is relatively large (scores of nm), such that the thickness of the electrode layer is increased, and it is not easy for the fuel to diffuse into the electrode layer. Furthermore, the weather resistant characteristic of the carbon carrier is poor. Under a state of long-term discharging, it may be oxidized to carbon dioxide, which gradually escapes, and as a result, the electrode structure breaks down. The catalyst is the one with the highest cost among the materials for manufacturing electrodes, so that preparing a platinum catalyst with a higher effective surface area is quite important in enhancing the performance and reducing the cost.

SUMMARY OF THE INVENTION

Accordingly, the present invention is directed to a method for manufacturing metal nano particles having a hollow structure, which is a simple process and capable of manufacturing metal nano particles with a uniform particle size and a large surface area.

The present invention is directed to a metal nano particle having a hollow structure, which can effectively improve the utilization efficiency of the catalyst, so as to greatly reduce the using amount of the catalyst, to reduce the production cost, and to enhance the potential for industrial applications.

As embodied and broadly described herein, the present invention provides a method for manufacturing metal nano particles having a hollow structure, which includes the following steps. First, a first solution having first metal ions is provided. Next, a reducing agent is added into the first solution, so as to precipitate first metal nano particles. Next, a second solution having second metal ions is added into the first solution, in which the reduction potential of the second metal is higher than that of the first metal. Then, the first metal nano particles are oxidized by the second metal ions from outside to inside, so as to form second metal nano particles having a hollow structure.

The method for manufacturing the metal nano particles having the hollow structure of the present invention has a simple process and can manufacture the metal nano particles with a uniform particle size and a large surface area.

The nano particles having a hollow structure manufactured by the method for manufacturing the metal nano particles having the hollow structure of the present invention can be applied to catalytic reaction of catalysts, materials for sensors, and materials for conductive films, so it has excellent potential for industrial applications.

The present invention provides a metal nano particle, which is manufactured by the method for manufacturing the metal nano particles having the hollow structure of the present invention.

When the metal nano particles having the hollow structure of the present invention are used as the catalyst, both the inner wall and the outer wall of the metal nano particles having the hollow structure can be used for the catalytic reaction, such that the utilization efficiency of the catalyst is improved, and the using amount and the cost of the catalyst are reduced.

Even though the metal nano particles having the hollow structure are aggregated together, the inner wall of the metal nano particles having the hollow structure can still achieve an effect in the reaction, so a significant large active area is maintained, and the performance of electrodes manufactured is less affected by the dispersity of catalyst.

In addition, when the metal nano particles having the hollow structure of the present invention are used as the catalyst, the active reaction surface area is enlarged by changing the form of the catalyst, without using a carrier or a protecting agent for assistance, so the process is relatively convenient. Additionally, the manufactured catalyst composition does not include the carrier, so the weather resistant characteristic is desirable.

In order to make the aforementioned and other objects, features, and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

First Embodiment

Figure 1:
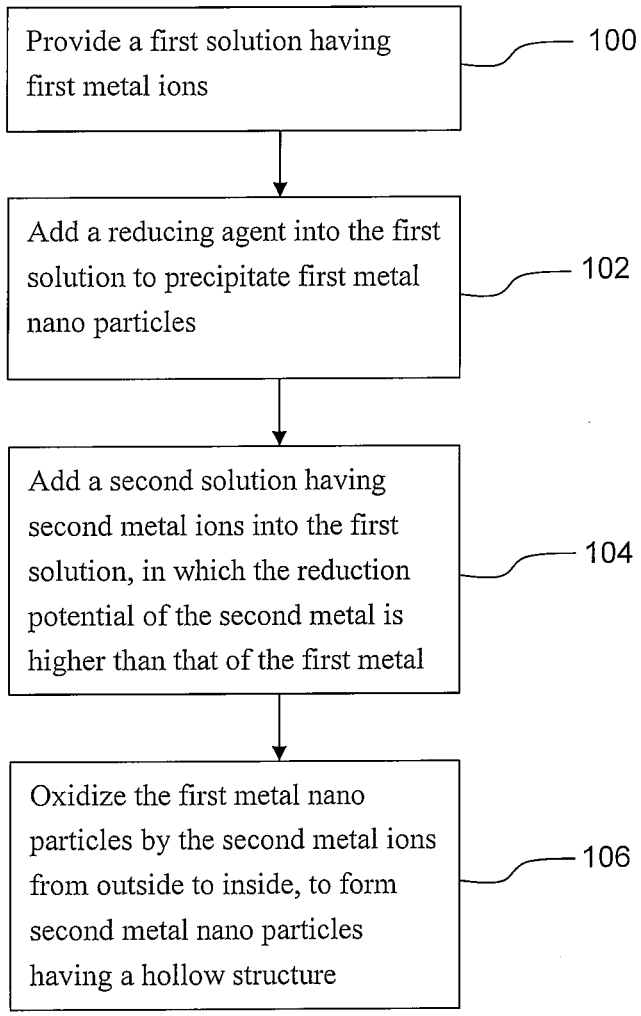
FIG. 1 is a flow chart of a method for manufacturing metal nano particles having a hollow structure according to the present invention.

FIG. 1 is a flow chart of a method for manufacturing metal nano particles having a hollow structure according to the present invention.

Referring to FIG. 1, the method for manufacturing the metal nano particles having the hollow structure of the present invention is illustrated below.

First, a first solution having first metal ions is provided (Step 100). The first metal ions are, for example, silver, copper, cobalt, nickel, or zinc.

Next, a reducing agent is added into the first solution, and the first metal ions are reduced to the first metal, so as to obtain first metal nano particles with a uniform particle size (Step 102). The reducing agent is, for example, methanol, ethanol, glycol, borohydride such as potassium borohydride and sodium borohydride, citric acid, tannic acid, sodium hypophosphite, or hydrazine.

In the Step 102, by means of controlling the temperature appropriately, the collision opportunity between the atoms is increased, and the distribution uniformity for the particle size can be improved. The first metal nano particles with different particle sizes can be obtained by means of changing the ratio of the concentration of the first metal ions to that of the reducing agent. The reaction temperature is, for example, 25° C.-80° C., and preferably 40° C.-70° C. The concentration of the first metal ions in the first solution is, for example, 0.4 mM-4 mM. The time cost for reducing the first metal ions to the first metal is, for example, 10-45 min.

Then, after the reducing agent is completely decomposed, a second solution having second metal ions is added into the first solution, in which the reduction potential of the second metal is higher than that of the first metal (Step 104). The second metal ions are, for example, platinum, ruthenium, rhodium, palladium, or molybdenum. The concentration of the second metal ions in the second solution is, for example, 0.4 mM-10 mM.

Next, the first metal nano particles are oxidized by the second metal ions from outside to inside, so as to form second metal nano particles having a hollow structure (Step 106). In Step 106, the reduction potential of the second metal is higher than that of the first metal, so the first metal nano particles in the solution are oxidized to the first metal ions, whereas the second metal ions are reduced to the second metal, so as to manufacture the second metal nano particles having the hollow structure. The reaction temperature is, for example, 25° C.-80° C., and preferably 40° C.-70° C. The time cost for oxidizing the first metal nano particles by the second metal ions from outside to inside to form the second metal nano particles having the hollow structure is, for example, 30-60 min.

The shape of the second metal nano particles having the hollow structure is changed depending upon the shape of the first metal nano particles manufactured in Step 102. For example, if the shape of the first metal nano particles is a sphere, the shape of the second metal nano particles is a hollow sphere; and if the shape of the first metal nano particles is a column, the shape of the second metal nano particles is a hollow column.

The nano particles having the hollow structure prepared by the method of the present invention can be applied to catalytic reaction of catalysts, materials for sensors, and materials for conductive films, so it has excellent potential for industrial applications.

Herein, the method for manufacturing the metal nano particles having the hollow structure of the present invention is described in detail below, by taking silver as the first metal and platinum as the second metal.

First, 50 ml silver nitrate solution is formulated. In the silver nitrate solution, the concentration of silver ions is 0.8 mM. Next, after a reducing agent sodium borohydride (with a concentration of 1 wt %, 2 ml) is added, and reacted for 15 min at a temperature of 60° C., such that the silver ions are reduced to silver, so as to obtain silver nano particles with a uniform particle size. Next, after the reducing agent is completely decomposed, a hexachloroplatinic acid solution of 50 ml is added (the concentration of the hexachloroplatinic acid ions is 0.8 mM), and reacted for 45 min, such that the silver nano particles are oxidized to silver ions, and the platinum ions are reduced to platinum, so as to form spherical shell-shaped platinum nano particles (the platinum nano particles having the hollow structure). The amount of the reducing agent (sodium borohydride) is approximately 50 times more than the required amount, the redundant reducing agent (sodium borohydride) is left in the water, and in the presence of the catalyst (the silver nano particles generated by reducing), the redundant reducing agent reacts with water to generate hydrogen gas and to form $NaBO_2$ to lose the reducing capability, so it no longer reacts with the subsequently-added chloroplatinic acid.

Figure 2:
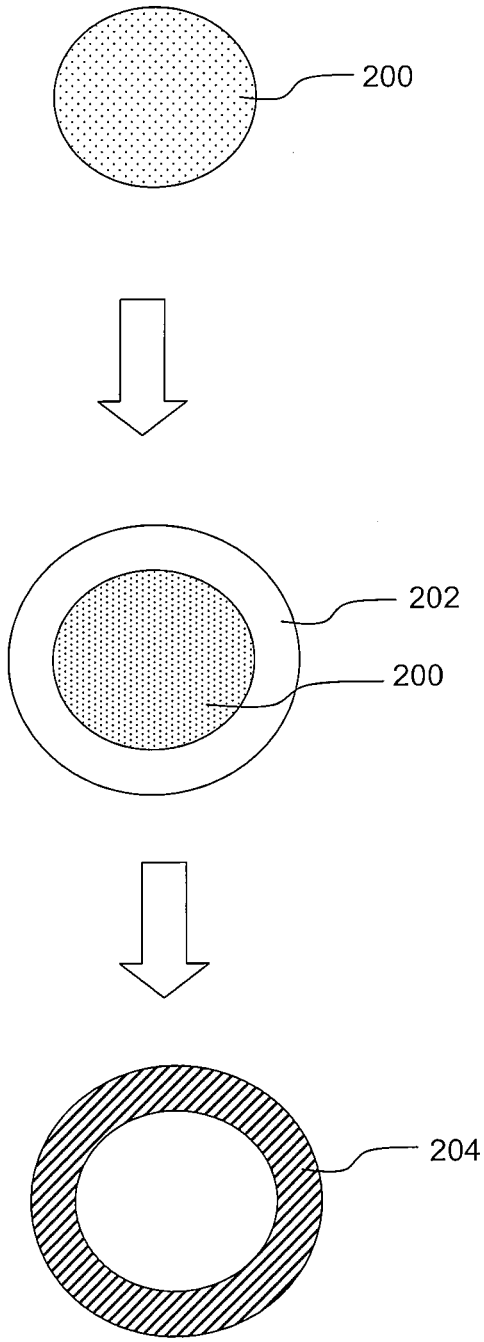
FIG. 2 is a schematic view of reacting from a silver nano particle to a spherical shell-shaped platinum nano particle.

FIG. 2 is a schematic view of reacting from a silver nano particle to a spherical shell-shaped platinum nano particle.

As shown in FIG. 2, when the silver nano particle 200 is oxidized to a silver ion ($Ag^+$), once every four silver ions ($Ag^+$) are oxidized, one platinum ion ($Pt^{4+}$) is reduced, so the silver nano particle 200 is oxidized by a hexachloroplatinic acid ion 202 from outside to inside, and the platinum is precipitated on the outer surface of the silver nano particle 200, so as to form a spherical shell-shaped platinum nano particle 204 (the platinum nano particle having the hollow structure).

Figure 3A:
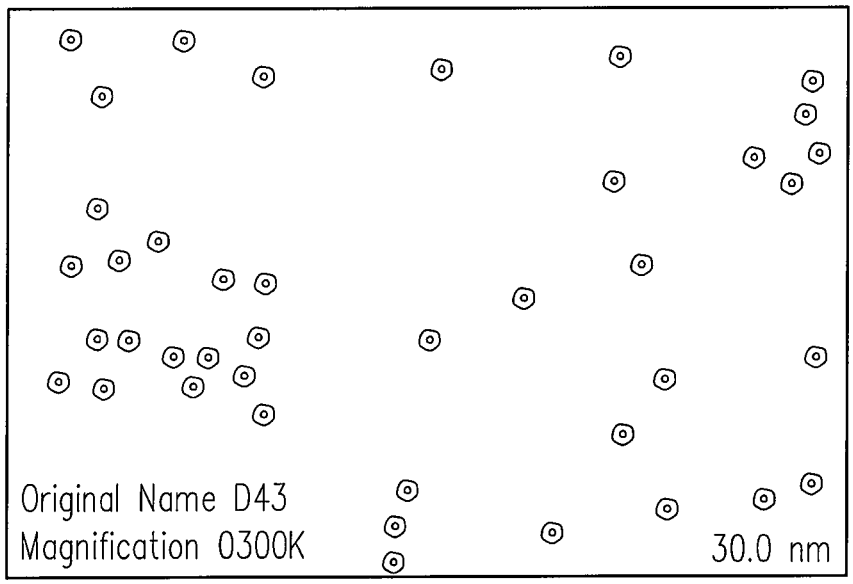
FIG. 3A is a photo diagram of the spherical shell-shaped platinum nano particles obtained via a transmission electron microscope.
Figure 3B:
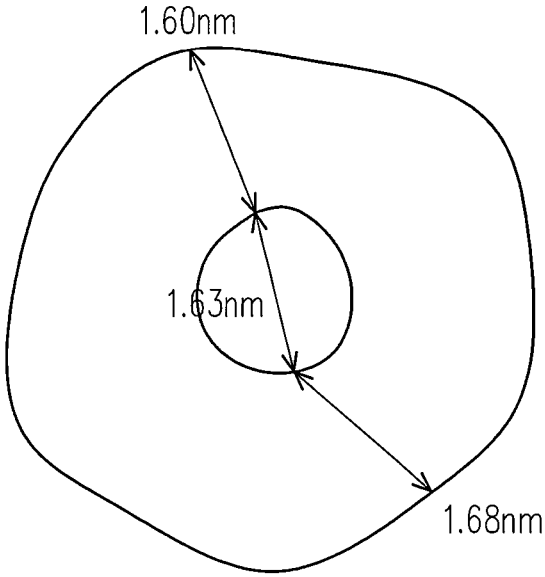
FIG. 3B is an enlarged view of a single spherical shell-shaped platinum nano particle obtained via a transmission electron microscope.

FIG. 3A is a photo diagram of the spherical shell-shaped platinum nano particles obtained via a transmission electron microscope. FIG. 3B is an enlarged view of a single spherical shell-shaped platinum nano particle obtained via a transmission electron microscope.

As shown in FIG. 3A, through the method for manufacturing the metal nano particles having the hollow structure of the present invention, the spherical shell-shaped platinum nano particles with an average outside diameter of approximately 4.6±0.9 nm are manufactured. As shown in FIG. 3B, the inner diameter of the hollow part of the spherical shell-shaped platinum nano particle is approximately 1.63 nm, and the thickness of the spherical shell (the thickness of the platinum) is approximately 1.6 nm.

When the spherical shell-shaped platinum nano particles of the present invention (the platinum nano particles having the hollow structure) are used as the catalyst, both the inner wall and the outer wall of the spherical shell-shaped platinum nano particles can be used in the catalytic reaction, which enhances the utilization efficiency of the catalyst, and reduces the using amount and the cost of the catalyst.

Even though the spherical shell-shaped platinum nano particles are aggregated together, the inner wall of the spherical shell-shaped platinum nano particles can still achieve an effect in the reaction, so a significant large active area is maintained, and the performance of electrodes manufactured is less affected by the dispersity of catalyst.

In addition, when the spherical shell-shaped platinum nano particles of the present invention (the platinum nano particles having the hollow structure) are used as the catalyst, the active reaction surface area is enlarged by changing the form of the catalyst, without using a carrier or a protecting agent for assistance, so the process is relatively convenient. Additionally, the manufactured catalyst composition does not include the carrier, so the weather resistant characteristic is desirable.

To sum up, the method for manufacturing the metal nano particles having the hollow structure has a simple process, and is capable of manufacturing the metal nano particles with a uniform particle size and a high surface area. The metal nano particles having the hollow structure can effectively improve the utilization efficiency of the catalyst, so as to greatly reduce the using amount of the catalyst, to reduce the production cost, and to improve the potential for industrial applications.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for manufacturing metal nano particles having a hollow structure, comprising:

providing 50 mL of a silver nitrate solution, wherein a concentration of a silver nitrate in the silver nitrate solution is 0.4 mM-4 mM;

adding 2 mL of a reducing agent into the silver nitrate solution to precipitate silver nano particles at 40° C-70° for 10 mM to 45 min, wherein a concentration of a sodium borohydride in the reducing agent is 1 wt%, and;

adding 50 mL of a hexachloroplatinic acid solution into the silver nitrate solution having the silver nano particles at 40° C-70° , wherein a concentration of a hexachloroplatinic acid in the hexachloroplatinic acid solution to be 0.4 mM-10 mM; and oxidizing the silver nano particles by platinum-ions from outside to inside to form platinum-nano particles having a hollow structure at 40° C-70° for 30 min to 60 min, wherein the platinum nano particles have an average outside diameter of 4.6±0.9 nm.

* * * * *